United States Patent [19]

Warnick

[11] Patent Number: 4,535,995

[45] Date of Patent: Aug. 20, 1985

[54] GAME APPARATUS

[76] Inventor: Gordon E. Warnick, 11837 Laurelwood Dr., Studio City, Calif. 91604

[21] Appl. No.: 533,242

[22] Filed: Sep. 19, 1983

[51] Int. Cl.[3] ..... A63F 3/00

[52] U.S. Cl. ..... 273/273

[58] Field of Search ..... 273/267, 269, 273, 274, 273/275, 276, 284, 293, 272, 292, 294, 153 R, 302, 303

[56] References Cited

U.S. PATENT DOCUMENTS

| | | | |
|---|---|---|---|
| D. 56,889 | 1/1921 | Richter | 273/292 X |
| 162,072 | 4/1875 | Hyatt | 273/293 |
| 630,485 | 8/1899 | Browne | 273/292 |
| 1,359,646 | 11/1920 | Zion | 273/273 X |
| 1,978,107 | 10/1934 | Hoffmann | 273/153 R |
| 4,236,720 | 12/1980 | Belony | 273/292 |
| 4,436,309 | 3/1984 | Barlow | 273/267 |

*Primary Examiner*—Harland S. Skogquist

*Attorney, Agent, or Firm*—Roger A. Marrs

[57] ABSTRACT

A game apparatus is disclosed herein including an elongated game board having a plurality of playing spaces arranged in rows extending longitudinally along the length of the game board and columns transversely arranged on the board. A plurality of elongated game pieces are arranged randomly adjacent the board. Graphic subject matter or indicia is carried on each of the board playing spaces as well as on each of a pair of graphic characters, and the object of the game is to align playing pieces with selected pairs of characters with identical pairs of characters carried on the game board by arranging the playing pieces either longitudinally or laterally in multiple tiers or levels on the game board.

1 Claim, 9 Drawing Figures

FIG. 1
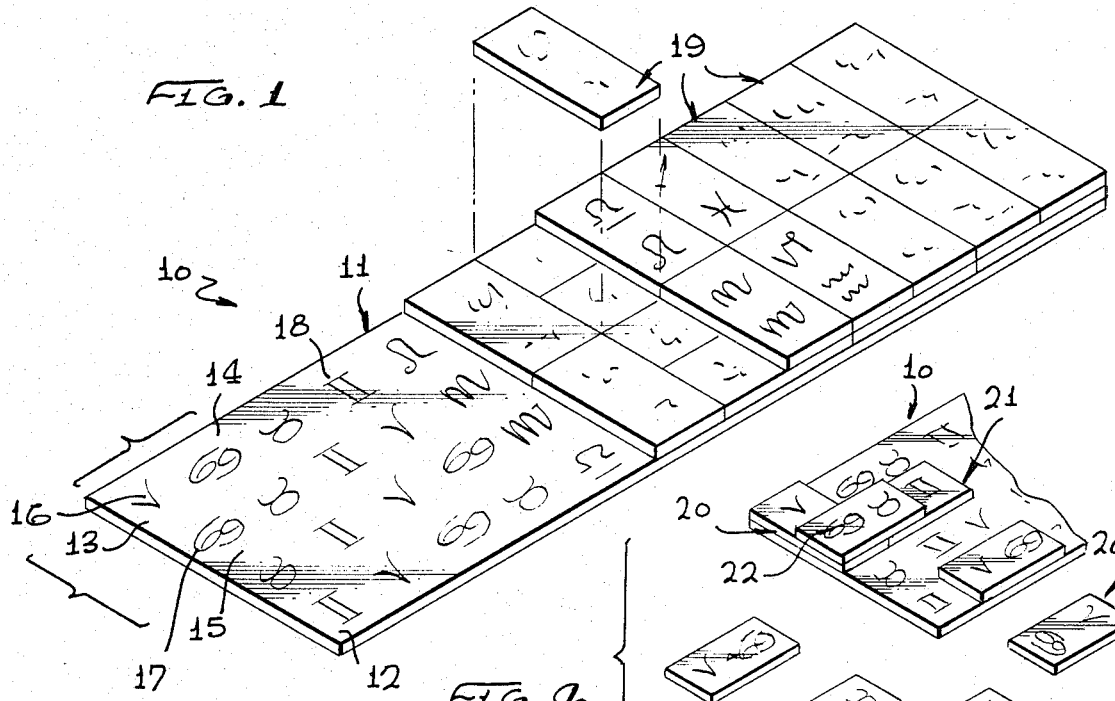
FIG. 4
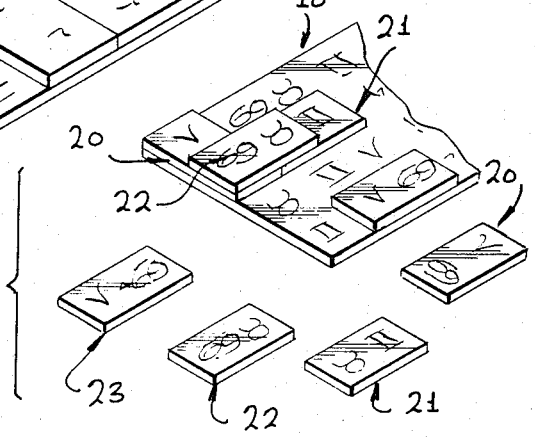
FIG. 2
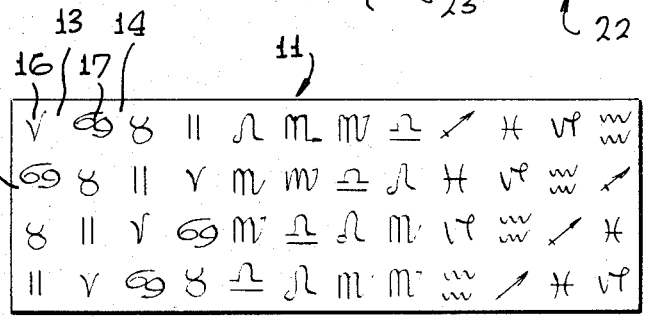
FIG. 3a
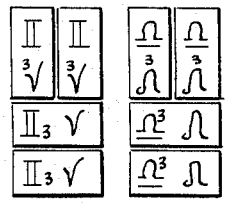
FIG. 3b
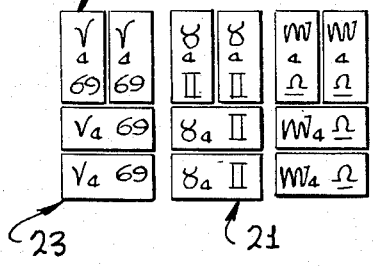
FIG. 3c
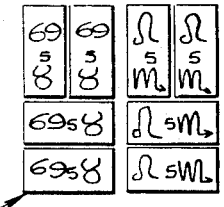
FIG. 3d
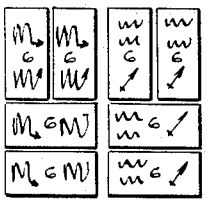
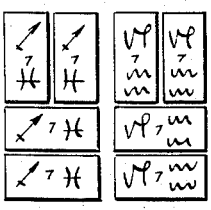
FIG. 3e
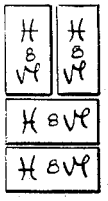
FIG. 3f

GAME APPARATUS

BACKGROUND OF THE INVENTION

1. Field of the Invention

This invention relates to game board apparatus and, more particularly, to novel apparatus of such a type in which the board bears graphic characteristics intended to be covered by a multiplicity of playing pieces displaying the same graphic characteristics whereby original, unique, and instructive games combining skill and chance may be devised.

Game boards have been provided in the past which have included a single course or path which is shared by many players as the players position or move tokens indicative of their play in response to some form of chance determining means such as a spinner, cards, dice, etc. The chance determining means usually indicates the length of move along the path or course and the player first reaching the end of the course is declared the winner. However, such conventional games do not allow for a high degree of player skill to be employed in determining the players length of move along the path or course in order to reach the determining end of the path or course with the highest score. Furthermore, inasmuch as a single path or course is provided, the outcome of conventional games does not depend on a "winning" combination of values such as may be provided by employing multiple paths or courses that are played simultaneously with player tokens or game pieces overlapping the paths or courses.

Consequently, most conventional games fall short of achieving intellectual stimulation in combination with multiple playing courses and multiple game pieces which overlap adjacent courses which will allow for a wide variety of games to be played upon a single board.

SUMMARY OF THE INVENTION

Accordingly, the above problems and difficulties encountered with conventional game apparatus are obviated by the present invention which provides a novel game apparatus having an elongated game board displaying a plurality of playing spaces arranged in longitudinal rows and lateral or transverse columns. The rows of playing spaces are parallel to one another and the lateral or transverse playing spaces are parallel with respect to one another so that the rows and columns are perpendicular and normal with respect to one another. Graphic indicia is disposed on the individual playing spaces represented by at least a pair of characters having a predetermined value or meaning. Identical pairs of characteristics or characters are displayed on each of a plurality of individual game pieces which are elongated in shape representing an area greater than the area of an individual playing space. In other words, the playing pieces are such that they will cover at least a pair of playing spaces on the game board either in a row or in a column whereby identical characters on the game pieces can be matched with the display characters on the individual playing spaces.

Therefore, it is among the primary objects of the present invention to provide a novel game board apparatus having multiple playing spaces representing longitudinal and transverse paths or courses which are simultaneously played upon by an individual player during his turn or action employing game pieces which are intended to cover adjacent playing spaces in either rows or columns in order to effect a "winning" combination of spaces or areas according to designated values or characters.

Another object of the present invention is to provide a novel game board apparatus having a plurality of playing spaces or areas displaying different graphic characters upon which an individual player places multiple tokens in an effort to combine similar graphic characters on each of the tokens with respective graphic characters on the playing spaces.

Still another object of the present invention is to provide a novel game board apparatus displaying a number of alpha-numeric or special characters arranged in separate longitudinal and transverse rows and columns which are covered by a plurality of individual playing pieces having identical alpha-numeric or alphabetic characters by an individual player during his turn for action to effect playing combinations so as to cover the surface of the game board.

Yet another object of the present invention is to provide apparatus for playing games in the use of which the outcome of the game is not entirely dependent upon the skill of the respective players in that certain elements of chance are involved in the playing of the game.

Still another object of the present invention is to provide a novel game board apparatus displaying a number of graphic indicia on which a plurality of game pieces may be placed matching indicia on the game pieces with the indicia of the game board surface such that highly amusing and interesting games can be played and which at the same time involves sufficient player skill to render attention, alertness and resourcefulness a large factor in the playing of the game.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description taken in connection with accompanying drawings in which:

FIG. 1 is a perspective view of the novel game apparatus of the present invention;

FIG. 2 is a top plan view of the game board used in the apparatus of FIG. 1;

FIGS. 3*a–f* illustrate a plurality of individual game pieces which are arranged in groups and which are placed on the surface of the game board as shown in FIG. 1 in order to match graphic indicia on the individual game piece with the indicia of the surface of the game board; and FIG. 4 is a perspective view showing a typical arrangement of game pieces on the game board during a course of play.

DESCRIPTION OF PREFERRED EMBODIMENT

Referring more particularly to FIG. 1 of the drawings, the game board apparatus of the present invention as a whole is indicated in the direction of numeral 10 and includes an elongated game board 11 in the standard of a rectangle having a planar surface 12. The playing surface includes a plurality of playing spaces such as spaces 13 and 14 extending longitudinally and spaces, such as space 15, arranged in a transverse or lateral direction. The plurality of playing spaces are arranged in horizontal rows across the longitudinal length of the board 11 and, in the present instance, four rows of playing spaces are employed which are disposed in parallel relationship with respect to one another across the entire surface of the board. Additionally, the spaces are arranged in vertical or transverse columns across the length of the board and the columns are perpendicular to, or normal to, the rows of spaces.

The playing surface is identified by a special arrangement of graphic indicia such as astrological glyphs. For example, the symbol for Aries is represented by numeral 16 and the symbol for Cancer is indicated by numeral 17. Still another symbol such as Gemini is indicated by numeral 18.

In addition to the game board 11, there are 48 individual and separate playing pieces such as playing piece 19 which are similarly identified by the special graphic indicia or characters representing astrological glyphs. Each playing piece includes a pair of the special astrological glyphs plus a number of a single digit. Each playing piece is rectangular in shape and the digit is located between the pair of glyphs. Twenty-four of the pieces are identified by this arrangement of glyphs-digit-glyphs oriented so that when viewed normally, the figures are parallel to the longitudinal axis of the rectangular playing piece. The remaining pieces are identified by having the special graphic indicia or arrangement of glyph-digit-glyph oriented so that when viewed normally the indicia is parallel to the shorter axis of the rectangular piece.

The playing surface 12 of the game board 11 is identified by four parallel tracks of playing spaces, each space displaying an astrological glyph so that 12 glyphs are arranged in each of the four parallel tracks. The 12 characters or glyphs in each track are oriented parallel to the longitudinal axis of the board when viewed normally. The special arrangement of indicia deviates from the accustomed order of the astrological glyphs in that the accustomed order represents the glyphs in the progression of the Zodiac, i.e., the glyph for Aries is followed by the glyphs representing Taurus, Gemini, and Cancer in that order. The special arrangement representing the deviation places these glyphs in an order representing the progression of the glyphs representing fire (Aries), water (Cancer), earth (Taurus), and air (Gemini). The same order governs the arrangement of second and third groups of four figures such as fire (Leo), water (Scorpio), earth ( Virgo ), and air (Libra), fire (Sagittarius), water (Pisces), earth (Capricorn), and air (Aquarius). The top most line of figures, as shown more clearly in FIG. 2, begins with the glyph for the fire sign, Aries, and when viewed from left to right, follows the fire, water, earth and air progression described above. The next lower line or track begins with the water sign, Cancer, and follows the same progression described above. The third lowest line or track begins with the earth sign, Taurus, and follows the progression described. The lowest line or track begins with the air sign, Gemini, and follows the progression described above.

Referring now in detail to FIG. 3, the playing pieces are of rectangular shape so as to have a longitudinal axis as well as a shorter transverse axis. Each of the respective playing pieces is identified by two graphic characters or glyphs separated by a single digit. The spacing between the glyphs match exactly with the spacing of the glyph figures or graphic indicia on the playing surface of the game board 11 and when the game pieces are superimposed on the playing surface 12, the glyphs or indicia on the playing pieces will match exactly with the indicia or glyphs on the playing surface whether between adjacent figures on the same track or line or matching figures on separate adjacent tracks or lines of glyphs.

Therefore, during a course of play, the procedure would call for an individual player to start with a cleared game board so that the full playing surface 12 is exposed to his view. All of the game pieces are turned upside down so that the blank back side of the game pieces are exposed and so that the graphic indicia or glyphs are not in view. The player picks up the playing pieces blind and after looking at the glyph pattern, places the playing piece onto the game board wherever the pattern matches. For example, referring to FIG. 4, game piece 20 having the symbols of Aries and Cancer may be placed on the vertical spaces associated with the bracket having number 13 in FIG. 1. Next, the player may pick up piece 21 and after viewing its graphic characters, match the characters with the characters of the game board and place the playing piece 21 over the symbols for Taurus and Gemini in the second track or row and occupying playing spaces in the second and third columns. Again, FIG. 4 shows the placement of playing piece 21 in this position. After another selection of playing piece, the player may draw playing piece 23 which is then placed, as shown in FIG. 4, on the lower track or row covering identical or matched symbols associated with columns two and three. This procedure continues until the player has placed as many playing pieces on the playing surface so as to cover it as completely as possible. When playing pieces are drawn that cannot be properly matched and placed on the game board on the first level or tier, the game pieces are placed in a pile face up so that the player may now draw from this pile for matching the glyphs on the playing pieces with exposed glyphs on the constructed game board with the first layer by constructing a second layer, tier or level. Each playing piece which was originally picked but could not be fitted in the first layer is then placed to cover two playing pieces with the same pattern. In this fashion, the playing piece being placed may cover the ends of two adjacent playing pieces in the first level. As an example, it can be seen in FIG. 4 that the playing piece 22 has been placed on the second row covering the first and second columns and alos covering the adjacent end of playing pieces 20 and 21. The selection of playing pieces continues until the player can no longer place any of the pieces on the pattern and then he may go back to the unused or remaining playing pieces in the blind turn down area and use these to complete the game.

The main object of the game is to place the playing pieces in such a manner that the entire playing surface 12 may be covered as completely as possible with a single level or tier of playing pieces. The full complement of 48 playing pieces are placed on the board in either two or more tiers so that the indicia on the superimposed playing pieces always match the indicia on the playing surface. In order to achieve this end, the player must have the skill of matching patterns and must intuitively or with intellectual guidance or spiritual guidance decide alternate patterns intended to be covered by a single game piece.

It will be appreciated from the foregoing description that the game board apparatus herein disclosed presents various combination situations and is one that develops interesting and perplexing situations. Often the developments of the game are such that the situation is rapidly cleared up during the final phase of play.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a game board apparatus to be played by a single person comprising the combination of:

an elongated game board having a playing surface permanently displaying a multiplicity of playing spaces arranged in parallel rows and parallel columns;

said playing surface characterized as being borderless;

each of said playing spaces displaying given combinations of a pair of different graphic indicia;

a plurality of playing pieces, each of which displays permanent predetermined combinations of graphic indicia on one single surface only of each piece identical to said combinations of graphic indicia displayed on said game board;

said playing piece graphic indicia adapted to correspond by matching with selected ones of said playing space given combinations whereby said playing piece covers at least two of said multiplicity of playing spaces;

said plurality of playing pieces comprising multiple pairs of playing pieces wherein each pair displays the same indicia and being adapted to be disposed in multiple levels or tiers covering said playing surface;

said elongated game board establishes a longitudinal axis and a transverse axis normal thereto whereby said rows are longer than said columns;

said playing spaces arranged in at least four rows and twelve columns;

each of said playing pieces are rectangular in shape and said predetermined combination of graphic indicia constituting a pair of different graphic indicia identical to certain pairs of graphic indicia displayed on said playing spaces;

said graphic indicia is selected from combinations of astrological signs arranged in a progression; and seclected ones of said playing pieces display said predetermined graphic indicia longitudinally along the length thereof and other playing pieces display said predetermined graphic indicia transversely across the length thereof.

* * * * *